US006247424B1

(12) United States Patent
Huang

(10) Patent No.: US 6,247,424 B1
(45) Date of Patent: Jun. 19, 2001

(54) TRAFFIC-CONTROL WARNING CONE

(76) Inventor: Wen-Hsin Huang, No. 7 Sublane 11, Lane 338, Tu An Street, Tao-Yuan City (TW)

( * ) Notice: Subject to any disclaimer, the term of this patent is extended or adjusted under 35 U.S.C. 154(b) by 0 days.

(21) Appl. No.: 09/517,553

(22) Filed: Mar. 2, 2000

(51) Int. Cl.[7] ..... E01F 9/12; E01F 9/017

(52) U.S. Cl. ..... 116/63 C; 404/10

(58) Field of Search ..... 428/34.1; 116/63 C; 404/10; 40/612

(56) References Cited

U.S. PATENT DOCUMENTS 5,993,105 * 11/1999 Chan ..... 116/63 C

* cited by examiner

*Primary Examiner*—Alexander S. Thomas
(74) *Attorney, Agent, or Firm*—Rosenberg, Klein & Lee

(57) ABSTRACT

A traffic-control warning cone includes a hollow cone at bottom end of which a proper area extends outwards and is formed as flat bottom, then extending outwards and upwards with a certain height and formed as a circular border. A heavy body is mounted on the flat bottom so that the whole body won't be toppled and be kept in an upright state no matter how it is placed so that the present invention won't be toppled, ensures the warning effect and enhances the convenience in using.

4 Claims, 6 Drawing Sheets

TRAFFIC-CONTROL WARNING CONE

BACKGROUND OF THE INVENTION

1. Field of the Invention

The present invention relates to a traffic-control warning cone, and more particularly, to an object which won't be toppled at all time so that the warning effect can be ensured and the convenience in using can be enhanced.

2. Description of the Prior Art

The center of gravity of a conventional warning cone (A), as shown in FIGS. 1 and 2, is too high so that it is easily toppled when touched; then, it will always be in a toppled state except that one brings it in place. Thus, its warning effect is much influenced. Patent applications of TW 82201436 and TW 84216193 disclose a cone whose stability is enhanced by filling water thereinto to increase its weight. However, its effect is very limited. When the touching force is too great, the filled water will flow and the center of gravity will shift to the toppling direction. Another patent application of TW 84211928 discloses a cone with movable feet to increase the bottom area thereof. Although it can enhance the effect of the stability, it will more or less cause the driving difficulty. In addition, the movable feet are often not seen by the drivers so that they are easily run over by cars. Furthermore, the movable feet have to be stretched out, and it causes to waste time.

SUMMARY OF THE INVENTION

It is a primary object of the present invention to provide a traffic-control warning cone which won't be toppled at all time so that the warning effect can be ensured and the convenience in using can be enhanced.

BRIEF DESCRIPTION OF THE DRAWINGS

The drawings disclose illustrative an embodiment of the present invention which serves to exemplify the various advantages and objects hereof, and are as follows.

DETAILED DESCRIPTION OF THE PREFERRED EMBODIMENT

Figure 3:
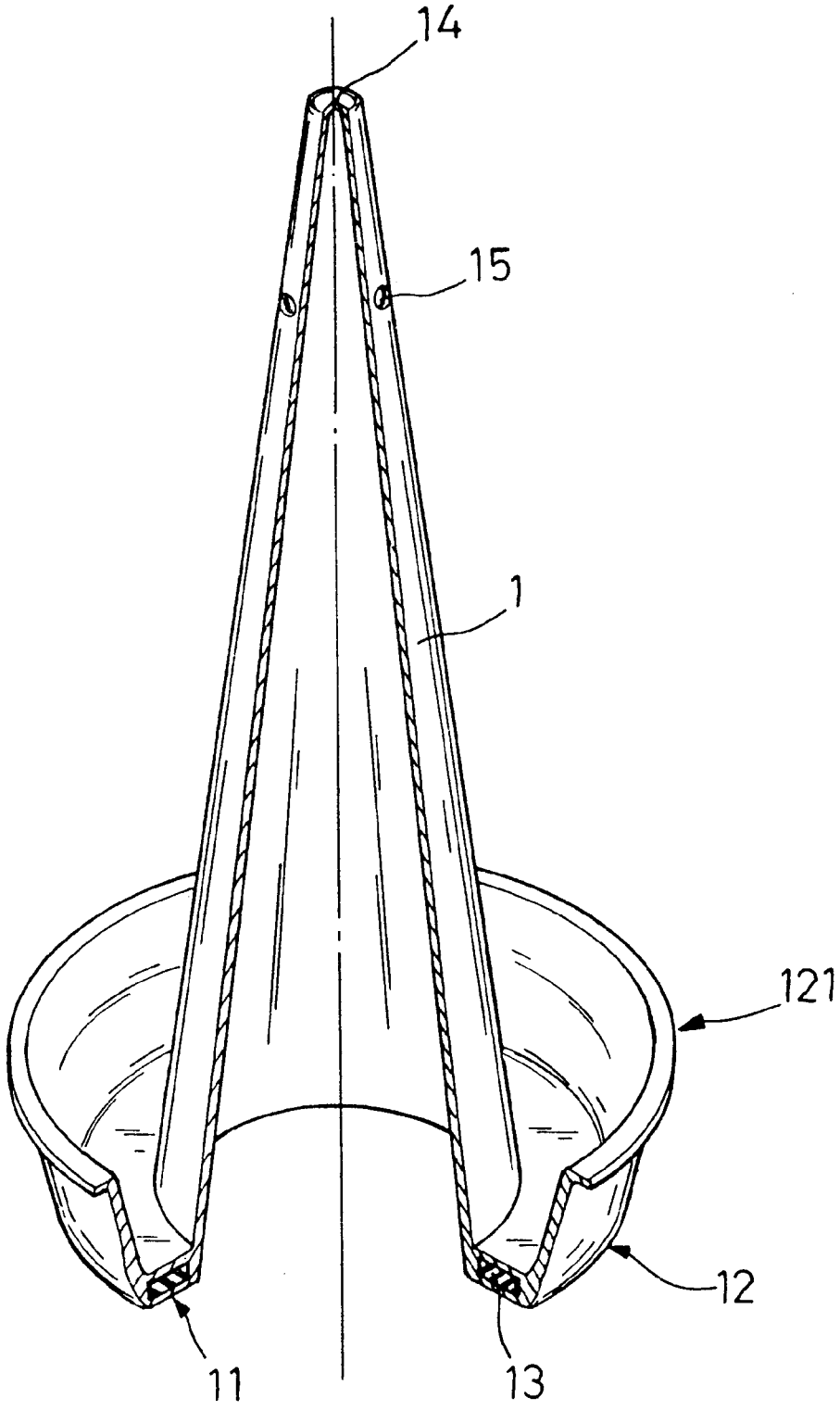
FIG. 3 is a half-section view of an applicable warning cone of the present invention.
Figure 4:
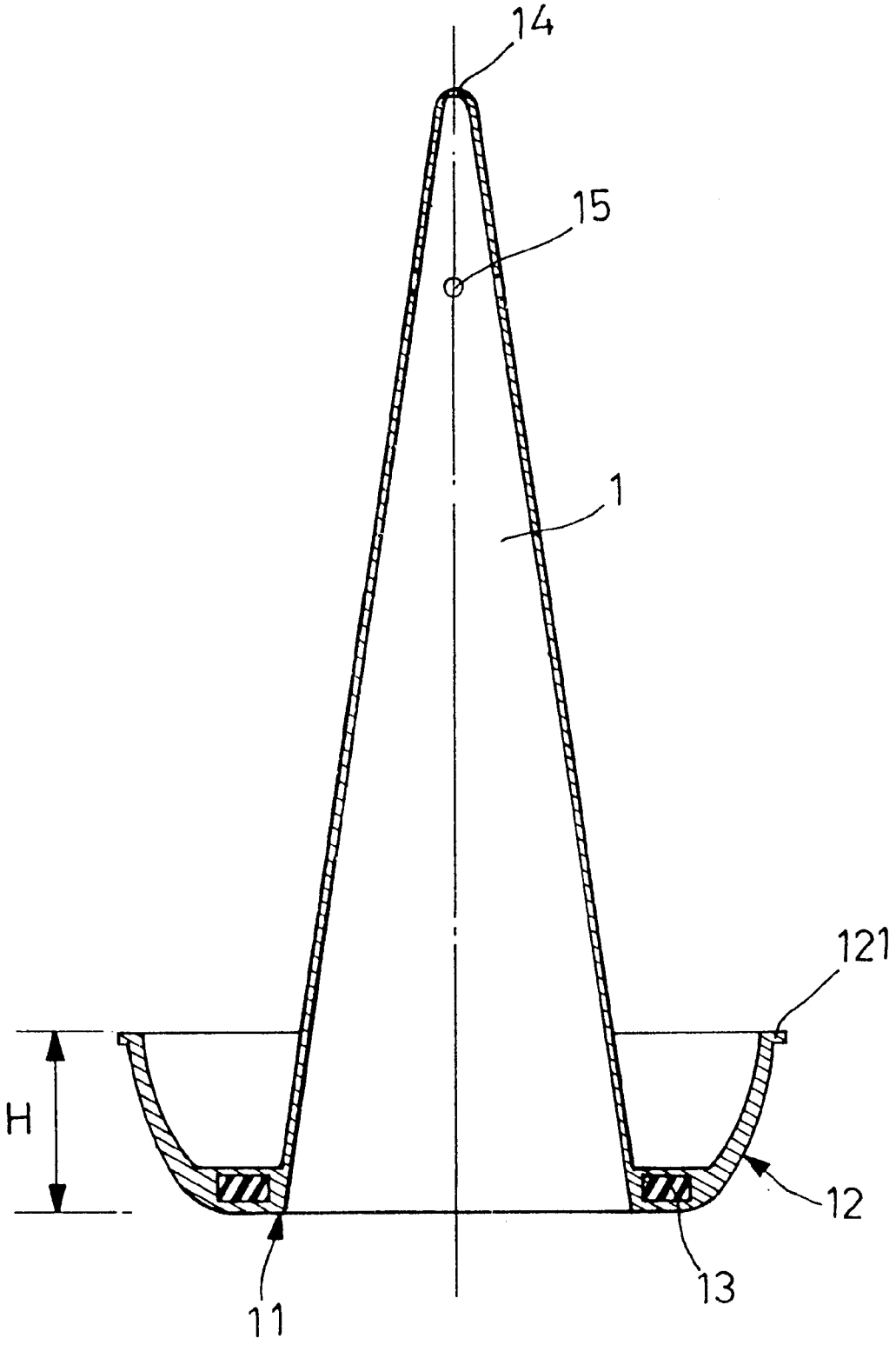
FIG. 4 is a fill sectional view of the applicable warning cone of the present invention.

First of all, referring to FIGS. 3 and 4, the traffic-control warning cone in accordance with the present invention includes a hollow cone 1 at bottom end of which a proper area extends outwards and is formed as flat bottom 11, then extending outwards and upwards with a certain height and formed as a circular border 12. A heavy body 13 is mounted on the flat bottom 11 so that the whole body won't be toppled and be kept in an upright state no matter how it is placed.

Furthermore, the circular border 12 has a protruding rim 121 at the top thereof in order to enhance the structural strength at the top rim of the circular border 12.

The hollow cone 1 has a plug-in hole 14 at the top end thereof which is used to plug a flag or an illuminating equipment thereinto.

The surface of the hollow cone 1 is fitted with a plurality of through holes 15.

The heavy body 13 disposed at the flat bottom 11 is used to lower the center (W) of gravity. In cooperation with the outward and upward arrangement of the circular border 12 and the special design of the flat bottom 11 with proper area, when the whole body is toppled to the outer side of the circular border 12, as shown in FIG. 5, or even filly toppled, as shown in FIG. 6, the moment of force created by the gravity enables the whole body to recover to the upright state because the center (W) of gravity is located at the bottom side of the vertical line (L) of the supporting point.

Figure 1:
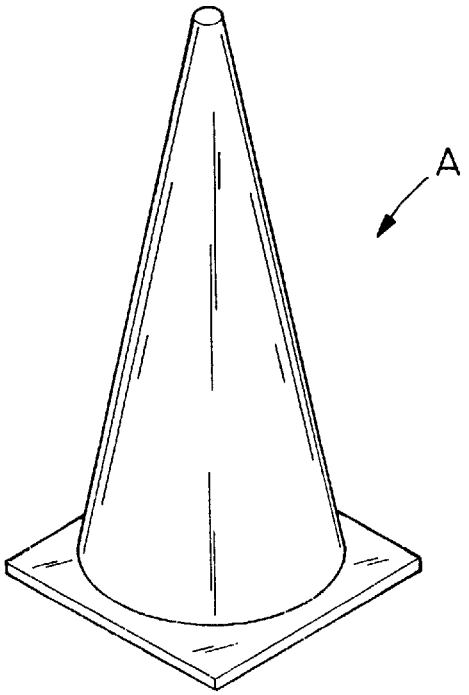
PRIOR ART FIG. 1
FIG. 1 is a schematic drawing of the structure of a conventional warning cone.
Figure 2:
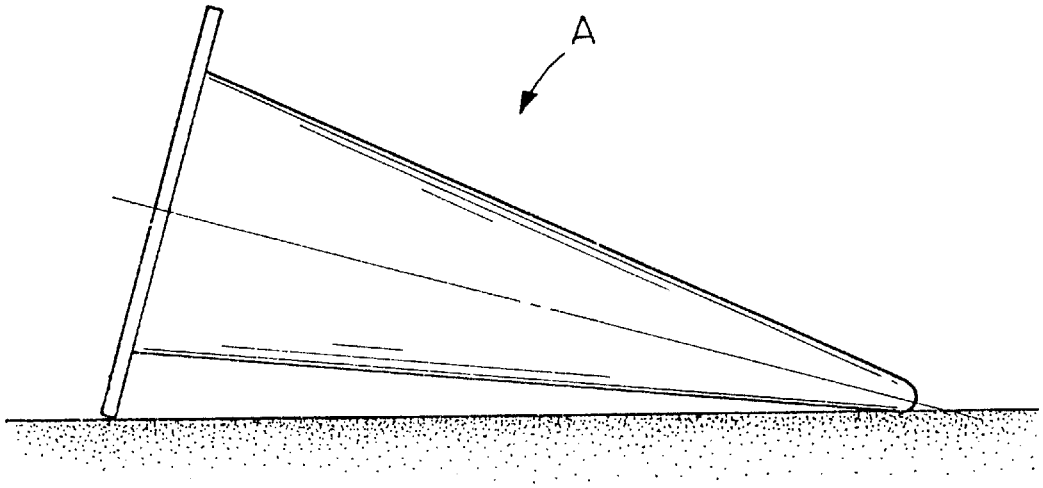
PRIOR ART FIG. 2
FIG. 2 is a schematic drawing of the conventional warning cone in a toppling state.
Figure 5:
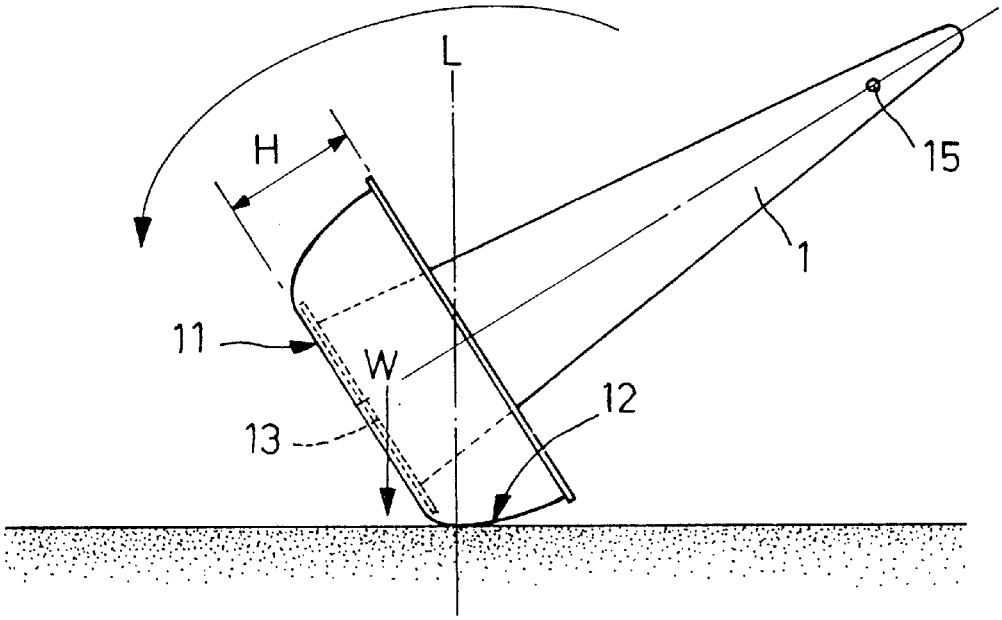
FIG. 5 is a first schematic drawing of the applicable warning cone of the present invention, illustrating the influence of its center of gravity upon the standing stability of the whole body.
Figure 6:
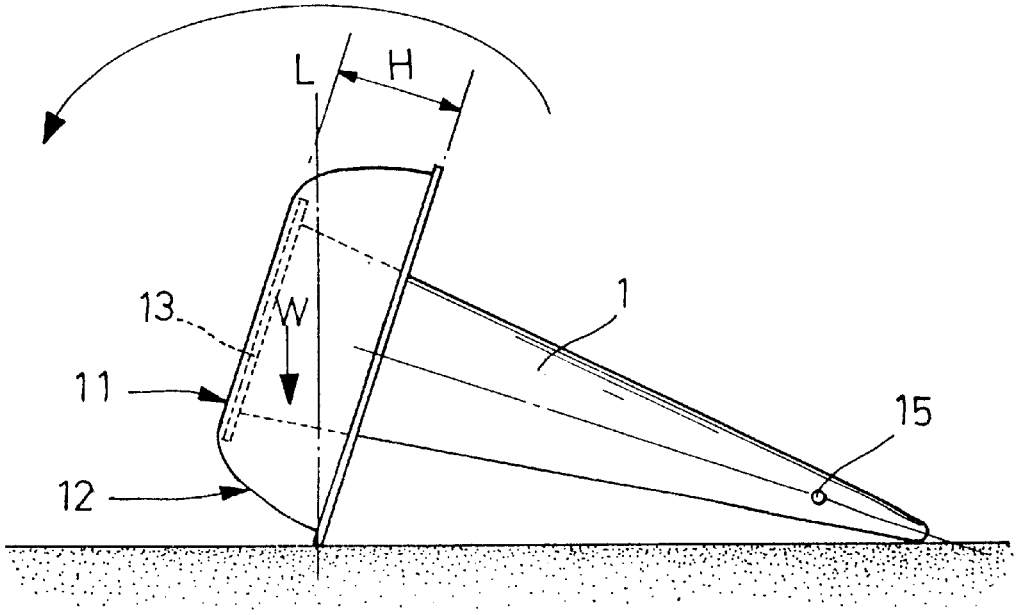
FIG. 6 is a second schematic drawing of the applicable warning cone of the present invention, illustrating the influence of its center of gravity upon the standing stability of the whole body.
Figure 7:
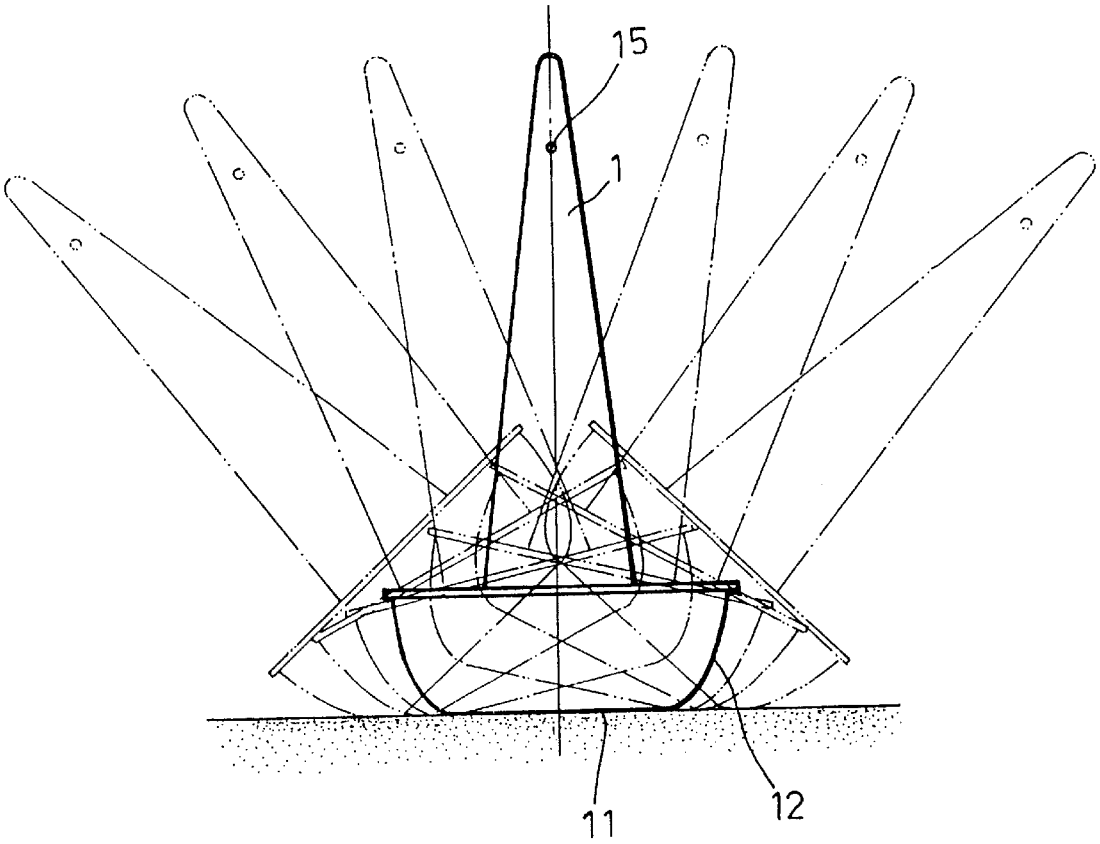
FIG. 7 is a schematic drawing of the applicable warning cone of the present invention in approaching to the stable state.

As illustrated in FIGS. 5 and 6, the structure of the present invention will always be kept in an upright state. No matter how it is toppled, it will always be recovered to a stable and upright state, as shown in FIG. 7, to ensure the warning effect. The conventional warning cone, as shown in FIGS. 1 and 2, must be brought at in an upright state or has to be filled with liquid or supported by feet while the present invention is always kept at an upright position so that the time to bring the warning cones in place can be spared or reduced.

Figure 8:
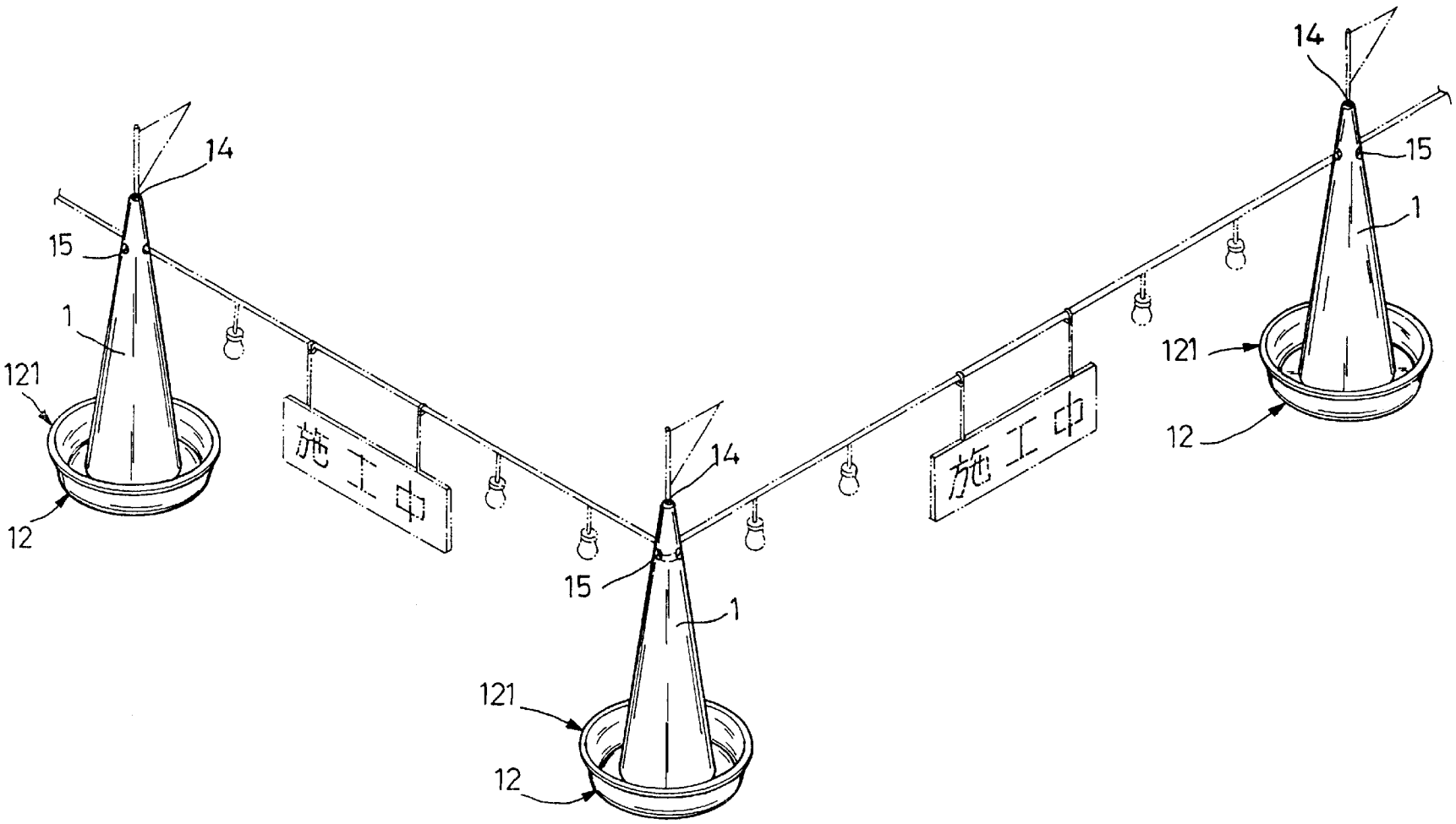
FIG. 8 is a schematic drawing of the applicable warning cones in connection with one another.

In the warning cone, as shown in FIG. 8, a rope penetrates through the through holes 15 to connect the warning cones together and to create a wide-range warning area. Moreover, an intensified warning effect is created by means that flags or illuminating equipment are inserted into the plug-in holes 14.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A traffic control warning cone comprising:

(a) an axially extended hollow cone portion having upper and lower ends and an intermediate section extending therebetween;

(b) an annular flat bottom portion coaxially disposed about said bottom end of said hollow cone portion to extend radially outward therefrom, said flat bottom portion including a heavy body for augmenting the weight thereof; and, (c) a circular border portion having an arcuate wall section extending axially upward and radially outward from an outer periphery of said flat bottom portion, said wall section terminating at an annular end section axially offset from said flat bottom portion;

whereby a center of gravity of said traffic control warning cone is disposed axially below said end section of said circular border portion.

2. The traffic control warning cone as recited in claim 1 wherein said end section of said circular border portion includes an annular rim protruding radially outward from said arcuate wall section.

3. The traffic control warning cone as recited in claim 1 wherein said upper end of said hollow cone portion has formed axially therethrough a plug-in hole for receiving an external member.

4. The traffic control warning cone as recited in claim 1 wherein said intermediate section of said hollow cone portion has formed therein a plurality of through holes.

* * * * *